US005505468A

United States Patent [19]

Pozzobon et al.

[11] Patent Number: 5,505,468

[45] Date of Patent: Apr. 9, 1996

[54] BRAKING DEVICE PARTICULARLY FOR SKATES

[75] Inventors: Alessandro Pozzobon, Paderno Di Ponzano Veneto; Renzo Balbinot, Pieve Di Soligo; Mario Gonella, Conegliano, all of Italy

[73] Assignee: Nordica S.p.A., Montebelluna, Italy

[21] Appl. No.: 136,054

[22] Filed: Oct. 14, 1993

[30] Foreign Application Priority Data

| | | | |
|---|---|---|---|
| Oct. 23, 1992 | [IT] | Italy | TV92A0122 |
| Mar. 5, 1993 | [IT] | Italy | TV93A0022 |

[51] Int. Cl.[6] ..... A63C 17/14

[52] U.S. Cl. ..... 280/11.2; 280/11.22

[58] Field of Search ..... 280/11.19, 11.2, 280/11.22, 11.23, 87.041, 87.042; 188/5, 6, 7

[56] References Cited

FOREIGN PATENT DOCUMENTS

| | | |
|---|---|---|
| 0414521 | 2/1991 | European Pat. Off. . |
| 1684806 | 2/1991 | Germany . |
| 104127 | 5/1923 | Switzerland . |

*Primary Examiner*—Richard M. Camby
*Attorney, Agent, or Firm*—Hale and Dorr

[57] ABSTRACT

Braking device, particularly usable for skates including a shoe composed of a quarter which is articulated to a shell which is in turn associated with a frame for supporting two or more wheels. A brake is rotatably associated with the quarter and selectively interacts with the ground upon a backward rotation of the quarter. The brake can oscillate in contrast with a spring and interacts with the ground upon a given rotation imparted to the quarter.

27 Claims, 3 Drawing Sheets

BRAKING DEVICE PARTICULARLY FOR SKATES

BACKGROUND OF THE INVENTION

The present invention relates to a braking device particularly usable for skates including a shoe composed of a quarter articulated to a shell which is in turn associated with a frame for supporting two or more wheels.

Conventional roller skates, whether constituted by a shoe associated with a support for two pairs of mutually parallel wheels or by a shoe associated with a supporting frame for two or more aligned wheels, have the problem of braking the wheels in order to adjust the speed of the skate.

It is known to use adapted pads or blocks, usually made of rubber, which are arranged at the toe or heel region of the shoe; when the user tilts the shoe or boot forwards or backwards, the free end of the pads or blocks interacts with the ground and braking is thus achieved.

However, these solutions are not optimum, since they require the user to rotate the shoe, and therefore the frame associated therewith, at the toe or at the heel, and this can cause losses of balance with consequent falls.

U.S. Pat. No. 1,402,010 is also known which discloses a roller skate provided with a band which can be secured on the leg of the user above the malleolar region and to which a rod is connected.

The rod surrounds the leg to the rear and is then curved so as to laterally affect it until it is associated, at its ends, in the malleolar region, with a lever system which is articulated to a structure protruding from the wheel supporting frame.

The lever system protrudes to the rear of the frame and is connected to a plate which is shaped approximately complementarily to the curvature of part of an underlying facing wheel.

This solution is not free from drawbacks: first of all, a relative movement is produced between the band and the leg during skating, and this does not make its use comfortable due to the continuous rubbing of the band on the leg.

Furthermore, the plate is activated every time the user bends his leg backwards beyond a given angle, with no actual and easy possibility of varying this condition.

Furthermore, each user has a different leg shape, thus producing a braking action at different rotation angles because the rod length is the same.

Furthermore, the rod rests and presses on the malleolar region, and this can cause discomfort or can cause accidental impacts; finally, considerable wear of the wheel is observed.

U.S. Pat. No. 4,275,895 is known as a partial solution to this drawback; this patent discloses a brake for skates provided with two pairs of mutually parallel wheels, which acts at the rear wheels.

The brake is constituted by a flap which is associated with the shoe in a rearward region and with which a plate is associated in a rearward position; the plate is pivoted at the supporting frame of the shoe.

The plate has, at its free end, a transverse element on which a pair of C-shaped elements is formed at the lateral ends; following a backward rotation imparted to the flap, said C-shaped elements interact with the rear wheels facing them, in that they interact with the rolling surface of said wheels.

However, even this solution has drawbacks: it is in fact structurally complicated and thus difficult to industrialize: furthermore, it entails the presence of adapted springs suitable to allow the flap to resume the position in which the pair of C-shaped elements does not interact with the wheels, thus further increasing structural complexity.

Furthermore, the structural configuration of the brake causes the pair of C-shaped elements to interact with the wheel even upon a minimal backward rotation imparted to the flap and thus even for involuntary movements, and this creates unwanted braking actions and thus possible losses of balance or lack of coordination.

Finally, the interaction of the C-shaped element at the rolling surface of the wheels leads to rapid wear of the wheels and thus to non-optimum rolling, which necessarily entails continuous replacement of the wheels.

U.S. Pat. No. 4,300,781 discloses a braking device for skates which comprise pairs of mutually parallel wheels.

The brake is constituted by a plate transversely pivoted at the rear end of the frame for supporting a shoe; blocks are associated with the ends of the plate and face the rolling surface of the pair of rear wheels.

The brake is activated by using a cable suitable to rotate the plate in contrast with a spring associated with the support for the pair of front wheels, so as to move the blocks into contact with the rolling surface of the pair of rear wheels.

The cable can be activated by means of rings or handles associated with a band which can be arranged on the legs of the user by virtue of the presence of temporary connection means.

However, this solution has considerable drawbacks: first of all, activation of the brake can lead to possible losses of balance during sports practice, because the user does not assume, with his body, a position suitable to control the sudden speed reduction; brake activation in fact involves only the skater's hand.

Furthermore, since the sport can be practiced while wearing trousers, when the rings are pulled the band may slip along the trousers or make them slide along the leg, hindering the braking action.

Furthermore, there is a loose cable which in addition to being a hindrance to the skater can accidentally catch during skating, especially since coordination of the arm-leg movement rhythmically moves the legs laterally outwards.

SUMMARY OF THE INVENTION

The aim of the present invention is to eliminate the drawbacks described above in known types by providing a braking device for skates which is structurally very simple and easy to industrialize.

Within the scope of the above aim, an important object is to provide a braking device which can be activated by the user in case of actual need and not accidentally.

Another important object is to provide a braking device which can be activated and deactivated rapidly and easily.

Another important object is to provide a device wherein activation of the braking action can be set by the user according to his individual requirements.

Another important object is to provide a braking device which protects the rolling surface of the wheels from wear.

Another important object is to provide a braking device which does not encumber the user during normal sports practice.

Another object is to obtain a device which associates with the preceding characteristics that of being reliable and safe in use, has low manufacturing costs and can also be applied to conventional skates.

This aim, these objects and others which will become apparent hereinafter are achieved by a braking device, particularly for skates which comprise a shoe composed of a quarter which is articulated to a shell associated with a frame for supporting two or more wheels, characterized in that a brake is rotatably associated with said quarter and selectively interacts with the ground upon a backward rotation of said quarter, said brake oscillating in contrast with at least one elastically deformable element.

BRIEF DESCRIPTION OF THE DRAWINGS

Further characteristics and advantages of the present invention will become apparent from the detailed description of a particular embodiment, illustrated only by way of non-limitative example in the accompanying drawings, wherein.

DESCRIPTION OF THE PREFERRED EMBODIMENTS

Figure 1:
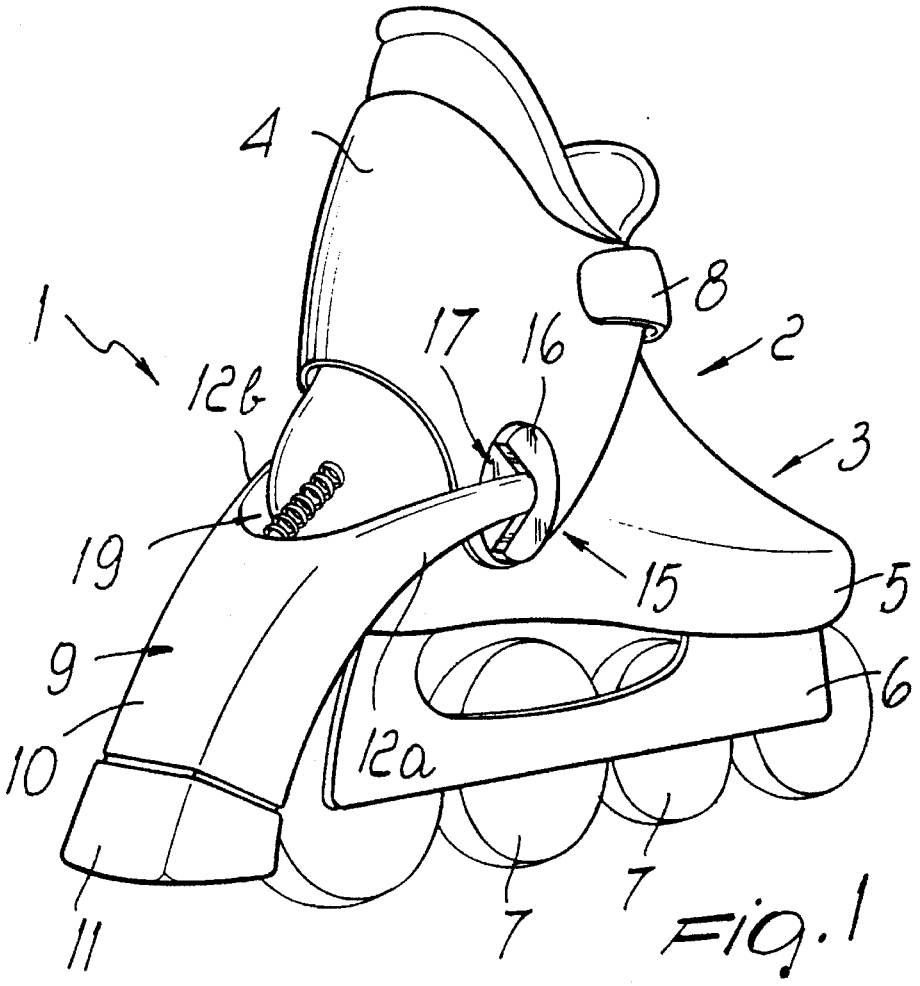
FIG. 1 is a rear perspective view of a skate provided with a braking device according to the invention.
Figure 2:
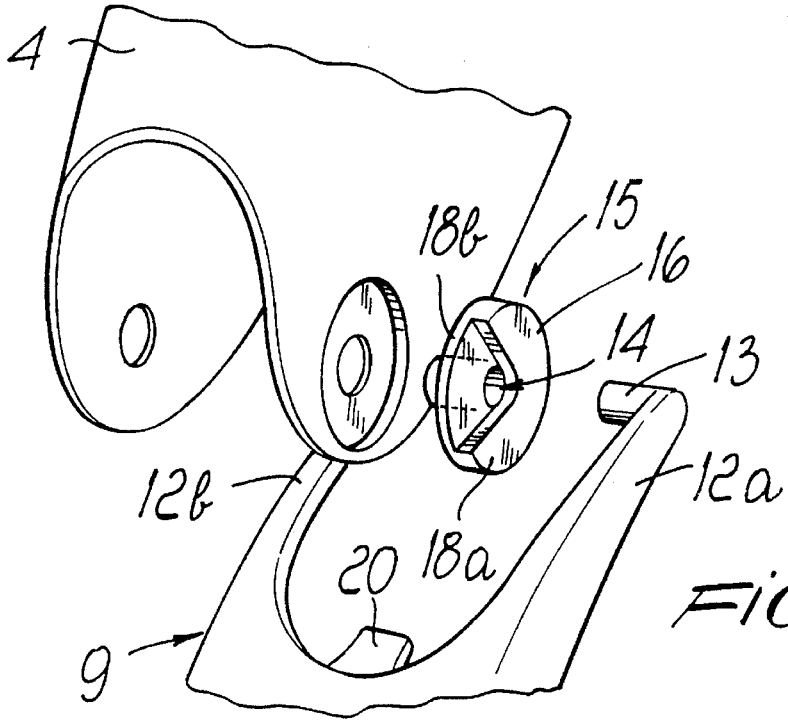
FIG. 2 is an exploded detail view of the connection between the arched member and the shell.

With reference to the above figures, the reference numeral 1 designates the braking device, which is particularly usable for a skate designated by the reference numeral 2.

The skate comprises a shoe 3 which is composed of a quarter 4 which surrounds the rear lateral region of the user's leg and is articulated to a shell 5. A frame 6 for supporting one or more wheels, designated by the reference numeral 7, for example mutually aligned, is associated below said shell.

Conventional fastening levers 8 may be provided at the quarter 4 and at the shell 5.

The braking device comprises a brake 9 which has an arched member 10 arranged to the rear of the shell 5 and frame 6. A block 11, suitable to interact with the ground, is associated with said arched member, and a pair of lateral wings 12*a* and 12*b* protrudes from said arched member, and can be elastically spaced apart. Wings 12*a*, 12*b* also have cylindrical pivots 13 at their ends.

The distance between said pair of wings is approximately equal to the width of the quarter, and the wings can be arranged laterally to the quarter and to the shell and can be rotatably associated therewith by inserting the pivots 13 within adapted first seats 14 which are formed axially with respect to the stem of a pair of pivoting studs 15 for the shell and the quarter.

A second seat 17 is formed on the head 16 of each stud so as to form two radial walls 18*a* and 18*b* between which an acute angle is formed. The ends of the lateral wings 12*a* and 12*b* of the brake 9 can swing between the radial walls.

The brake is kept in neutral position, approximately so that the ends of the lateral wings 12*a* and 12*b* are arranged along the bisecting line of the angle formed between the two radial walls, by means of an elastically deformable element, such as preferably a spring 19 which is associated with the shell 5 and with the body 10 of the brake 9 at its ends.

A tab 20 is advantageously provided in the part of the body 10 which faces the shell 5 and is suitable to abut on the shell 5 in the heel region when the brake 9 is in its retracted inactive position; in this manner, the upward stroke of the brake 9 is limited, preventing unpleasant oscillations of said brake which can hinder the performance of the skate while skating.

The use of the present invention is as follows: during normal skating, the quarter 4 is free to tilt with respect to the shell 5 without affecting the brake 9.

The second seats 17 are in fact formed on the heads of each stud so as to form, between the side walls 18*a* and 18*b*, such an angle that rotation of the stud does not make said side walls interact with the ends of the lateral wings 12*a* and 12*b* of the brake 9, which thus remains in neutral position.

Beyond a given angle of backward rotation of the quarter 4, the side wall 18*b* abuts the end of the lateral wings of the brake, making it move and thus making it rotate so that the pad 11 interacts with the ground.

The spring 19 allows to pull back the brake 9 once the quarter 4 has returned to an upright position or has moved beyond a given rotation angle.

The angle of backward rotation of the quarter, which allows interaction between the ends of the lateral wings 12*a* and 12*b* and the side walls 18*a* and 18*b*, can be set by virtue of adapted means such as, for example, pads which are arrangeable on the lateral wings or on the walls.

It has thus been observed that the present invention has achieved the intended aim and objects, a braking device having been obtained which can be activated by the user at a presettable angle of backward rotation imparted to the quarter, this being obtainable as a function of the shape and dimensions of the lateral wings of the brake or of their possible curvature with respect to the body 10 and of the angle formed between the side walls of the second seats 17.

Furthermore, both activation and deactivation of the brake are very simple, so as to allow to obtain a device which is structurally simple and easy to industrialize and can also be easily applied to known skates.

Furthermore, the movements of the quarter are not limited by the presence of the brake, which acts only when braking is actually wanted.

Furthermore, since there are no elements subject to constant movement, both during skating and during braking, there is less wear on the components.

Figure 3:
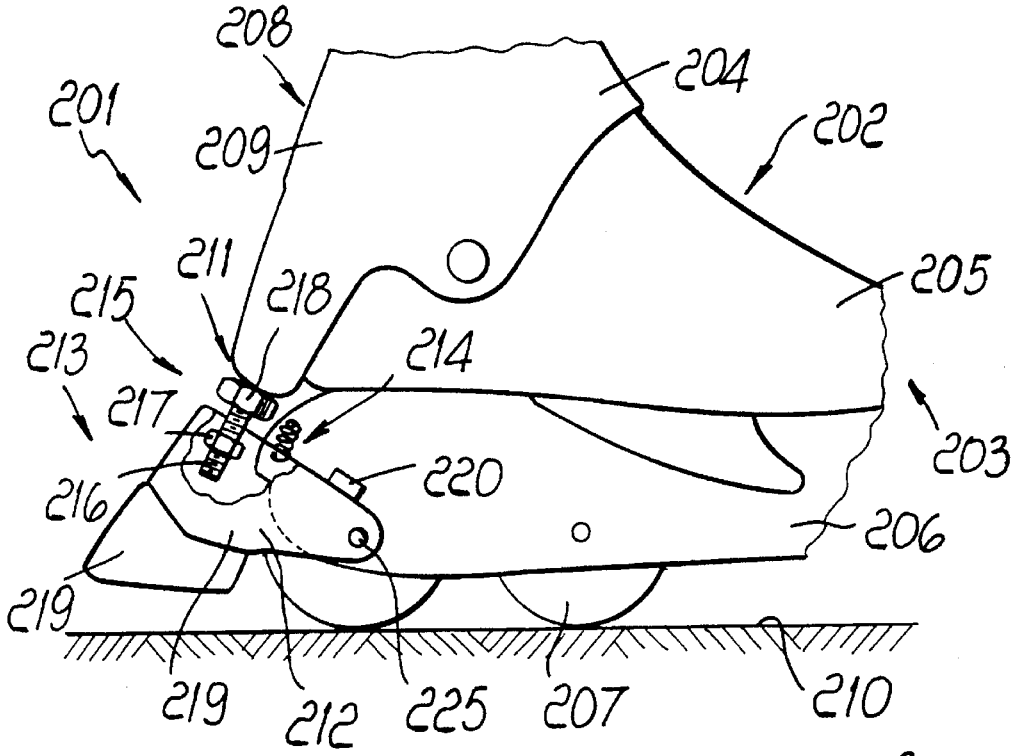
FIG. 3 is a side partial view of a skate having a braking device according to a further aspect of the invention.

FIG. 3 illustrates a braking device 202, according to a second aspect of the invention, particularly usable for skates designated by the reference numeral 202.

The skate comprises a shoe 203 composed of a quarter which surrounds the rear lateral region of the user's leg and is articulated to a shell 205 with which a frame 206 is associated in a lower region. The frame supports one or more wheels, designated by the reference numeral 207, possibly arranged so that they are mutually aligned.

Conventional fastening levers can be applied to the quarter 204 and the shell 205.

The braking device has at least one tab 209 associated with the quarter 204 at the rear region 208 and extending longitudinally toward the ground 210.

The end 211 of the tab 209 is advantageously flat and ends in a region which is adjacent to, and lies above, the body 212 of a brake 213 which is articulated to the frame in contrast with at least one elastically deformable element 214 such as a spring which is associated, at its ends, with said body 212 and with said frame 206. The end 211 of the tab 209 temporarily interacts by abutment upon a backward rotation of said quarter 204 with the facing body 212 of the brake 213.

The body 212 is articulated to the frame 206 by means of a pivot 225.

Advantageously, means suitable to vary the mutual distance between the facing ends of said tab and said brake are associable with the tab 209 or with the brake 213.

In the particular embodiment shown in FIG. 3, said means are constituted by a screw 215 in which the threaded stem 216 interacts with a complementarily threaded nut 217, associated inside the body 212 of the brake 213, and the head 218 whereof faces the end 211 of the tab 209.

By screwing or unscrewing the screw 215 it is thus possible to vary the mutual distance between the end 211 of the tab and the corresponding facing end of the body 212 of the brake.

The use of device according to the present invention is in fact as follows: a given backward rotation imparted to lo the quarter 204 is followed by a movement of the tab 209 which is such as to move its end 211 into contact with the body 212 of the brake 213, which is thus subjected to a rotation causing the pad 219 to interact with the ground 210.

The presence of the spring allows to pull back the brake 213 once the quarter 204 has been moved forwards again, whereas the presence of a stroke limiting element, such as a ridge 220 which is located on the frame 206 and interacts with the underlying body 212, allows to limit the oscillation of the brake 213 toward said frame 206.

Finally, the angle of groundward rotation of the quarter which allows interaction between the ends 211 and the body 212 can be changed by virtue of the presence of the screw 215; this adjustment is particularly useful for compensating the wear of the pad 219.

It has thus been observed that the present invention has achieved the intended aim and objects, since a braking device has been obtained which can be activated by the user at a presettable backward rotation angle imparted to the quarter, and this can be achieved by imparting the required shape or length to the tab or the required adjustment degree to the screw 15.

Furthermore, the braking kinematic system is more compact, and the system can also be provided as a separate accessory which can be installed on the skate by the user.

The means suitable to vary the mutual distance between the facing ends of said tab and brake may be constituted by a telescopic element which is associated with said at least one tab so as to allow an intended elongation thereof.

As an alternative, it is possible to consider a screw the threaded stem whereof is associated with a complementarily threaded nut embedded in the tab.

The tab 209 can furthermore be formed monolithically together with the quarter 204 or can be applied thereon or associated therewith by virtue of adapted means for permanent or temporary connection.

Figure 4:
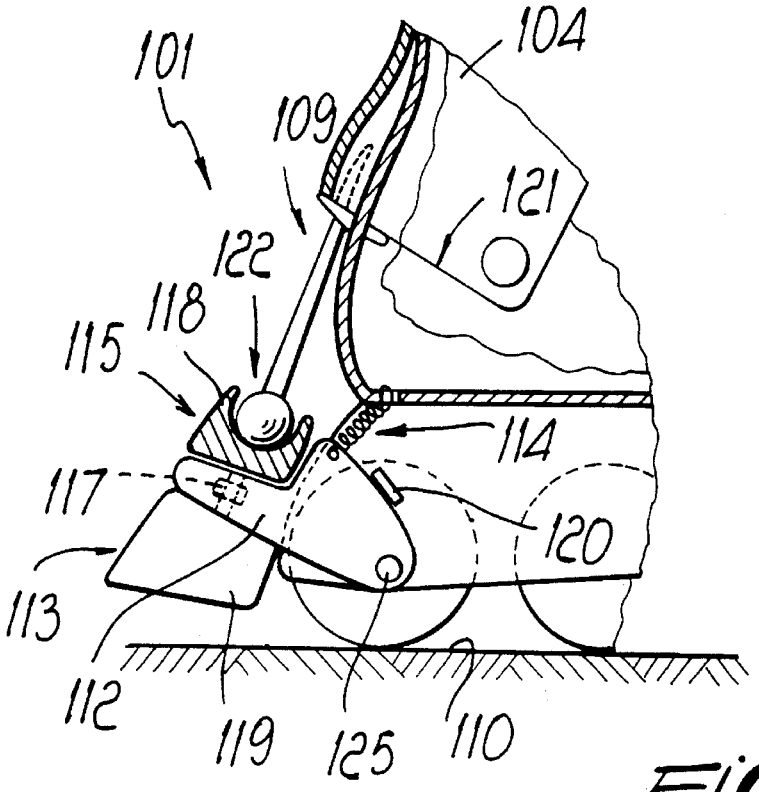
FIG. 4 is a side partial view of a skate having a braking device according to a third aspect of the invention.
Figure 5:
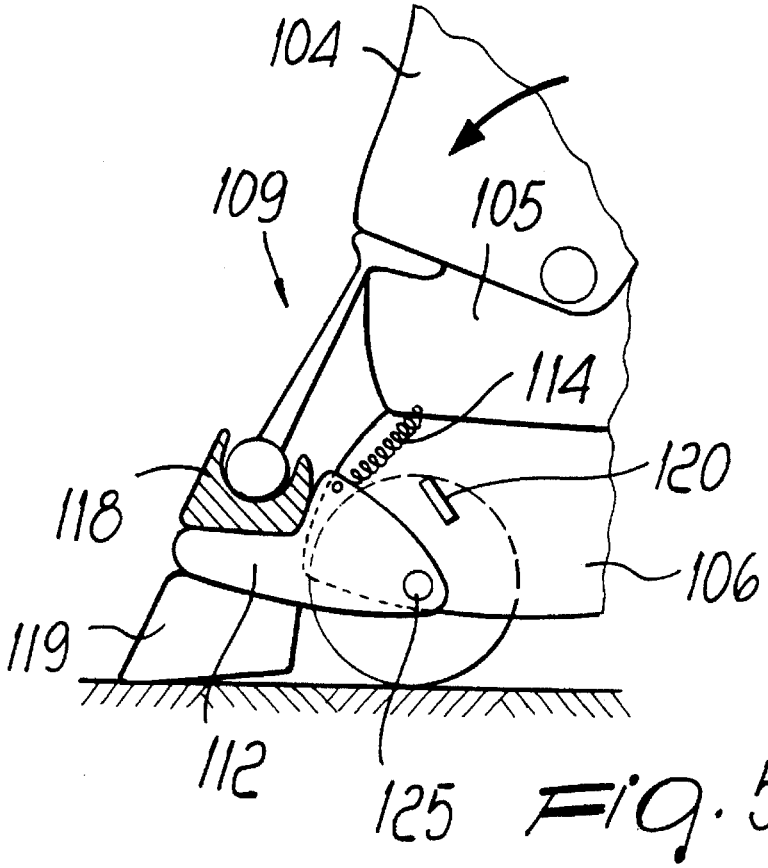
FIG. 5 is a view similar to that of FIG. 4, showing the braking device in the braking position.
Figure 6:
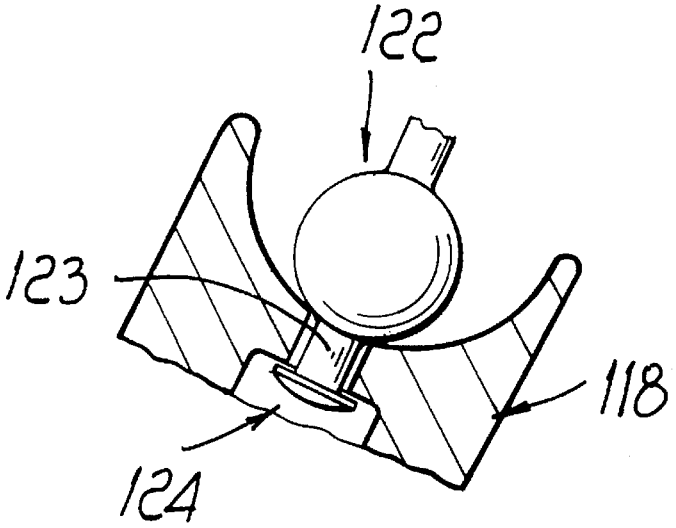
FIG. 6 is a detail section view of the rod member of the device of FIGS. 4 and 5.

FIGS. 4–6 illustrate a further embodiment of a braking device 101, which comprises a quarter 104 with which at least one rod member 109 is associated at the perimetric edge 121 in a rear and lower region. A body 112 is articulated to the frame 106, by means of a pivot 125, and is adapted to support a pad 119. The free end 122 of said rod member, which is directed toward the ground 110, is advantageously spherical.

The rod member 109 is arranged between the quarter 104 and the body 112 of the brake 113, with the possible interposition of a means suitable to vary the mutual distance between the facing ends of the rod member and of the brake. The means is constituted by a screw 115 in which the head 118 is suitable to accommodate, for example with a snap action, the end 122 of the rod member, and the stem 116 whereof is associated with a complementarily threaded nut 117 embedded in the body 112.

As an alternative, the end 122 of the rod member 109 has, at the head 118, a protrusion 123 which is associated, with or without a snap action, within an adapted seat 124 formed on said head.

An elastically deformable element, such as a spring 114, is interposed between the shell 105 or the frame 106 and the body 112 of the brake 113, together with a stroke limiter 120 for the rotation of the body toward the frame.

This solution also achieves the intended aim and objects.

Naturally, the materials and the dimensions which constitute the individual components of the braking device may be the most pertinent according to the specific requirements.

We claim:

1. Braking device particularly for skates which comprise a shoe composed of a quarter which is articulated to a shell associated with a frame for supporting two or more wheels, said device comprising a brake rotatably associated with said quarter and selectively interacting with the ground upon a backward rotation of said quarter, said brake oscillating in contrast with at least one elastically deformable element, wherein said brake has a body which is arranged to the rear of said skate, a pad suitable to interact with the ground being associated with said body, a pair of lateral wings protruding from said body, wherein said lateral wings can be spaced apart elastically and have cylindrical pivots at their ends, wherein the distance between said pair of wings is approximately equal to the width of said quarter, said wings being arranged laterally to said quarter and to said shell, and wherein said pair of wings is rotatably associated with said quarter by means of the insertion of said cylindrical pivots within adapted first seats formed axially with respect to the stem of a pair of pivoting studs for said shell and said quarter.

2. Braking device according to claim 1, wherein a second seat is formed on the head of each one of said studs so as to form two radial walls between which an acute angle is formed.

3. Braking device according to claim 2, wherein said brake is kept in neutral position, and thus approximately so that the ends of said lateral wings are arranged along the bisecting line of the angle formed between said two radial walls, by virtue of an elastically deformable element.

4. Braking device according to claim 3, wherein said elastically deformable element is constituted by at least one spring which is associated with said shell and said brake at its ends.

5. Braking device according to claim 4, wherein the angle formed between said side walls of said second seats is such that the rotation of said studs during normal skating does not make said side walls interact with said ends of said lateral wings of said brake.

6. Braking device according to claim 5, wherein beyond a given angle of backward rotation of said quarter, one of said side walls interacts by abutment with one of said ends of said lateral wings of said brake, making it move and thus rotate so that said pad interacts with the ground.

7. Braking device according to claim 6, wherein at least one tab protrudes toward said shell from said body and is suitable to interact by abutment with said shell when the brake is not activated.

8. Braking device particularly for skates which comprise a shoe composed of a quarter which is articulated to a shell associated with a frame for supporting two or more wheels, said device comprising a brake for selectively interacting with the ground upon a backward rotation of said quarter, wherein said brake comprises a body articulated to said frame by means of a pivot, said body supporting a pad, and wherein at least one tab is associated with said body, said tab temporarily interacting by abutment with said shell upon a backward rotation of said quarter, said brake oscillating in contrast with at least one elastically deformable element.

9. Braking device according to claim 8, wherein means suitable to vary the mutual distance between the facing ends of said tab and said brake are arranged between said tab and said brake.

10. Braking device according to claim 9, wherein the end of said tab is flat and ends in a region which is adjacent to, and lies above, the body of said brake, which is articulated manner to said frame in contrast with said at least one elastically deformable element, such as a spring which is associated, at its ends, with said body and said frame.

11. Braking device according to claim 10, wherein said end of said tab interacts temporarily, by abutment, with said facing body of said brake upon a preset backward rotation of said quarter.

12. Braking device according to claim 11 wherein means suitable to vary the mutual distance between the facing ends of said tab and said brake are associated with either one of said tab and said brake, said means being constituted by a screw in which the threaded stem interacts with a complementarily threaded nut which is internally associated with said body of said brake and the head whereof faces said end of said tab.

13. Braking device according to claim 12, wherein it comprises a stroke limiting element, such as an abutment located on said frame, which interacts with said underlying body, and is suitable to limit the oscillation of said brake toward said frame.

14. Braking device particularly for skates which comprise a shoe composed of a quarter which is articulated to a shell associated with a frame for supporting two or more wheels, said device comprising a brake for selectively interacting with the ground upon a backward rotation of said quarter, wherein said brake comprises a body articulated to said frame by means of a pivot, said body supporting a pad, and wherein at least one rod member is associated with said quarter in a rear and lower region, said rod member interacting temporarily by abutment with said brake upon a backward rotation of said quarter, said brake oscillating in contrast with at least one elastically deformable element.

15. Braking device according to claim 14 wherein said at least one rod member is associated with said quarter at the perimetric edge in a rear and lower region, the free groundward end of said rod member being spherical, said rod member being arranged between said quarter and said body of said brake with the possible interposition of a means suitable to vary the mutual distance between the facing ends of said rod member and said brake.

16. Braking device according to claim 15 wherein said means is constituted by a screw the head whereof is suitable to accommodate the end of said rod member, with a snap action, and the stem whereof is associated with a complementarily threaded nut embedded in said body.

17. Braking device according to claim 16, wherein said end of said rod member has, at said head, a protrusion which is associated, with or without a snap action, within an appropriate seat formed on said head.

18. Braking device according to claim 8, wherein it comprises a stroke limiting element provided on said frame and adapted to engage said body for limiting the rotation thereof.

19. Braking device according to claim 14 further comprising means for varying the mutual distance between the facing ends of said rod member and said brake.

20. Braking device particularly for skates which comprise a shoe composed of a quarter which is articulated to a shell associated with a frame for supporting two or more wheels, said device comprising a brake movable upwardly and downwardly relative to said frame and selectively interacting with the ground upon a backward rotation of said quarter, said brake oscillating in contrast with at least one elastically deformable element, wherein said brake comprises a body articulated to said quarter, said body supporting a pad, and wherein at least one wall portion is associated with said quarter, said wall portion temporarily interacting by abutment with said brake upon a backward rotation of said quarter, said brake oscillating in contrast with at least one elastically deformable element.

21. In a skate comprising a frame supporting two or more wheels, a quarter pivotal relative to the frame, and a brake mounted to the rear of the frame and movable towards the ground in response to backward rotation of said quarter, that improvement wherein:

said quarter is pivotal relative to said frame between a first forward position, a second rearward position, and a third position intermediate said first forward position and said second rearward position; and, a first actuating surface fixed with respect to and movable with said quarter engages a second actuating surface fixed with respect to and movable with said braking element when said quarter is in positions between said third and second positions thereof and is spaced from said second actuating surface when said quarter is in positions between said first and third positions, pivoting of said quarter towards said second position moving said braking element towards the ground when said quarter is between said second and third positions but not when said quarter is between said first and third positions.

22. The skate of claim 21 including an elastically deformable element attached to said brake and exerting force on said braking element in a direction tending to move said braking element away from the ground, said elastically deformable element moving said braking element away from the ground when said quarter is in positions between said first and third positions.

23. The skate of claim 21 wherein said braking element includes a body arranged to the rear of said skate, a brake pad attached to said body, and a wing protruding from said body and pivotally connected to said quarter, said quarter includes a projection adjacent the connection of said quarter to said wing and defining said first actuating surface, and said wing defines said second actuating surface.

24. The skate of claim 23 including an elastically deformable element attached to said brake and exerting force on said braking element in a direction tending to move said braking element away from the ground, said elastically deformable element moving said braking element away from the ground when said quarter is in positions between said first and third positions.

25. The skate of claim 21 including a rod member associated with a lower and rearward portion of said quarter and extending generally towards said braking element, said first actuating surface being defined by said rod member.

26. The skate of claim 21 wherein the position at which one of said actuating members is fixed relative to the respective one of said quarter and said braking element is adjustable relative to said respective one, whereby the distances between said third position and, respectively, said first and second positions may be varied.

27. The skate of claim 26 including an elastically deformable element attached to said brake and exerting force on said braking element in a direction tending to move said braking element away from the ground, said elastically deformable element moving said braking element away from the ground when said quarter is in positions between said first and third positions.

* * * * *

UNITED STATES PATENT AND TRADEMARK OFFICE

CERTIFICATE OF CORRECTION

PATENT NO. : 5,505,468

DATED : April 9, 1996

INVENTOR(S) : Alessandro Pozzobon, et al.

It is certified that error appears in the above-indentified patent and that said Letters Patent is hereby corrected as shown below:

Column 4, line 67, after "frame" insert --206--.

Column 5, line 22, after "to" delete "lo".

Signed and Sealed this

Thirteenth Day of August, 1996

*Attest:*

Bruce Lehman

BRUCE LEHMAN

*Attesting Officer*

*Commissioner of Patents and Trademarks*